US006398052B1

(12) United States Patent
Cheng et al.

(10) Patent No.: US 6,398,052 B1
(45) **Date of Patent: *Jun. 4, 2002**

(54) BOTTLE WITH INTEGRATED GRIP PORTION

(75) Inventors: Jizu John Cheng, Burr Ridge; Jeffrey D. Krich, Orland Park, both of IL (US)

(73) Assignee: Crown Cork & Seal Technologies Corporation, Alsip, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/694,941

(22) Filed: Oct. 24, 2000

Related U.S. Application Data

(62) Division of application No. 09/196,719, filed on Nov. 20, 1998, now Pat. No. 6,164,474.

(51) Int. Cl.[7] ..... B65D 90/02
(52) U.S. Cl. ..... 215/384; 215/381; 220/669
(58) Field of Search ..... 215/381–384; 220/608, 675, 669

(56) References Cited

U.S. PATENT DOCUMENTS

| | | | | |
|---|---|---|---|---|
| D38,430 | S | 1/1907 | Pressing | |
| D66,789 | S | 3/1925 | Curran | D9/553 |
| D67,946 | S | 8/1925 | Council | D9/553 |
| 1,602,391 | A | 10/1926 | Creaver | 215/384 |
| 1,636,174 | A | 7/1927 | Dolan et al. | |
| D85,109 | S | 9/1931 | Mas | D9/553 |
| D91,653 | S | 3/1934 | Guyer | |
| D94,384 | S | 1/1935 | Fuerst | D9/543 |
| D144,247 | S | 3/1946 | Graham | D9/543 |
| D159,169 | S | 6/1950 | Smith | D58/25 |
| D198,407 | S | 6/1964 | Busch | D58/5 |
| 3,152,710 | A | 10/1964 | Platte | 215/1 |
| 3,225,950 | A | 12/1965 | Josephsen et al. | 215/384 |
| 3,308,997 | A | 3/1967 | Kelly | 215/284 X |
| D217,439 | S | 5/1970 | Platte | D9/44 |
| 3,536,500 | A | 10/1970 | Cleereman et al. | 99/171 |
| 4,318,882 | A | 3/1982 | Agrawal et al. | 264/521 |
| D277,551 | S | 2/1985 | Kerr | D9/267 |

(List continued on next page.)

FOREIGN PATENT DOCUMENTS

| | | |
|---|---|---|
| EP | 1 025 007 | 12/1999 |
| EP | 1 012 047 | 6/2000 |
| WO | WO 99/08945 | 2/1999 |
| WO | WO 99/18013 | 4/1999 |
| WO | WO 00/35759 | 6/2000 |
| WO | WO 00/51895 | 9/2000 |

*Primary Examiner*—Stephen P. Garbe
*Assistant Examiner*—Joseph C. Merek
(74) *Attorney, Agent, or Firm*—Woodcock Washburn LLP

(57) ABSTRACT

A bottle for storing and dispensing contents comprises at least one grip portion for improving a user's grip on the bottle. The grip portion is situated on the side of the bottle and extends at least partially along the height of the bottle and comprises a recessed grip panel formed in the side of the bottle adapted to receive the user's fingers and the grip panel is tapered at an angle with respect to the vertical direction. Preferably, the back of the bottle is thinner than the front so that a user can grip the bottle from the back. Preferably, there are a plurality of ribs inclined at a first angle with respect to the horizontal direction and a plurality of cross-hatch ribs inclined at a second angle, the second angle differing from the first at approximately ninety degrees and the ribs forming a lattice arrangement. Preferably, the bottle further comprises a plurality of ridges, situated on the side wall of the bottle for providing strength and rigidity to the bottle. The ridge is a depression across a part of the height of the bottle, has an underside, and extends at least partially along the side wall and comprises a lower portion that extends from the side wall toward the center axis of the bottle so that the contents beneath or on the underside of the ridge can be reached with a utensil.

3 Claims, 6 Drawing Sheets

U.S. PATENT DOCUMENTS

| | | | | |
|---|---|---|---|---|
| 4,497,855 | A | 2/1985 | Agrawall et al. | 428/35 |
| D278,978 | S | 5/1985 | Franchi et al. | D9/383 |
| D279,167 | S | 6/1985 | Haney et al. | D9/378 |
| D281,577 | S | 12/1985 | Larson et al. | D9/367 |
| D282,349 | S | 1/1986 | Larson et al. | D9/395 |
| 4,570,808 | A | 2/1986 | Campbell et al. | 215/11 R |
| D294,462 | S | 3/1988 | Ota et al. | D9/392 |
| D294,463 | S | 3/1988 | Lang | D9/392 |
| 4,804,097 | A | 2/1989 | Alberghini et al. | 215/100 A |
| 4,805,788 | A | 2/1989 | Akiho | 215/1 C |
| 4,813,556 | A | 3/1989 | Lawrence | 215/11.3 |
| 4,863,046 | A | 9/1989 | Collette et al. | 215/1 C |
| 4,877,141 | A | 10/1989 | Hayashi et al. | 215/1 C |
| 4,885,809 | A | 12/1989 | Muchmore | 4/259 |
| 4,890,752 | A | 1/1990 | Ota et al. | 215/1 C |
| D305,984 | S | 2/1990 | Alberhini et al. | D9/393 |
| 4,946,053 | A | 8/1990 | Conrad | 215/1 C |
| 4,969,922 | A | 11/1990 | Platte, Sr. | 215/1 C |
| 4,979,628 | A | 12/1990 | Robbins, III | 215/1 C |
| 4,993,565 | A | 2/1991 | Ota et al. | 215/1 C |
| 4,993,566 | A | 2/1991 | Eberle | 215/1 C |
| 4,993,567 | A | 2/1991 | Eberle, Jr. | 215/1 C |
| D315,869 | S | 4/1991 | Collette | D9/392 |
| 5,005,716 | A | 4/1991 | Eberle | 215/1 C |
| 5,027,963 | A | 7/1991 | Robbins, III | 215/1 C |
| D318,798 | S | 8/1991 | Biesecker | D9/378 |
| D320,154 | S | 9/1991 | Alberghini et al. | D9/370 |
| 5,052,567 | A | 10/1991 | Colani | 215/100 A |
| 5,054,632 | A | 10/1991 | Alberghini et al. | 215/1 C |
| D321,830 | S | 11/1991 | York et al. | D9/434 |
| 5,064,081 | A | 11/1991 | Hayashi et al. | 215/1 C |
| 5,092,474 | A | 3/1992 | Leigner | 215/1 C |
| 5,092,475 | A | 3/1992 | Krishnakumar et al. | 215/1 C |
| 5,103,988 | A | 4/1992 | Reil et al. | 215/100 A |
| 5,122,327 | A | 6/1992 | Spina et al. | 264/534 |
| 5,141,120 | A | 8/1992 | Brown et al. | 215/1 C |
| 5,141,121 | A | 8/1992 | Brown et al. | 215/100 A |
| 5,148,930 | A | 9/1992 | Ota et al. | 215/1 C |
| 5,156,285 | A | 10/1992 | Zogg et al. | 215/100 A |
| 5,158,190 | A | 10/1992 | Sosenko | 215/1 R |
| 5,165,557 | A | 11/1992 | Ota et al. | 215/1 C |
| 5,178,289 | A | 1/1993 | Krishnakumar et al. | 215/1 C |
| 5,178,290 | A | 1/1993 | Ota et al. | 215/1 C |
| D334,713 | S | 4/1993 | Segati | D9/543 |
| 5,199,587 | A | 4/1993 | Ota et al. | 215/1 C |
| 5,199,588 | A | 4/1993 | Hayashi | 215/1 C |
| 5,215,203 | A | 6/1993 | Malcolm | 215/100 A |
| 5,222,615 | A | 6/1993 | Ota et al. | 215/1 C |
| D337,520 | S | 7/1993 | Krishnakumar et al. | D9/434 |
| 5,224,614 | A | 7/1993 | Bono et al. | 215/100 A |
| 5,226,550 | A | 7/1993 | Mikolaitis et al. | 215/1 C |
| 5,255,889 | A | 10/1993 | Collette et al. | 249/102 |
| 5,261,543 | A | 11/1993 | Ugarelli | 215/1 C |
| 5,279,433 | A | 1/1994 | Krishnakumar et al. | 215/1 C |
| D344,457 | S | 2/1994 | Prevot et al. | D9/537 |
| D345,693 | S | 4/1994 | Edstrom | D9/332 |
| 5,303,833 | A | 4/1994 | Hayashi et al. | 215/1 C |
| 5,303,834 | A | 4/1994 | Krishnakumar et al. | 215/1 C |
| D347,391 | S | 5/1994 | Guertin | D9/566 |
| 5,322,184 | A | 6/1994 | Bergner et al. | 220/771 |
| 5,330,054 | A | 7/1994 | Brown | 206/459.5 |
| 5,337,909 | A | 8/1994 | Vailliencourt | 215/1 C |
| 5,341,946 | A | 8/1994 | Vailliencourt et al. | 215/1 C |
| 5,350,078 | A | 9/1994 | Potts et al. | 215/384 |
| D352,238 | S | 11/1994 | Vailliencourt et al. | D9/434 |
| D352,245 | S | 11/1994 | Krishnakumar et al. | D9/538 |
| D354,685 | S | 1/1995 | Krishnakumar et al. | D9/543 |
| 5,381,910 | A | 1/1995 | Sugiura et al. | 215/1 C |
| 5,392,937 | A | 2/1995 | Prevot et al. | 215/1 C |
| D357,188 | S | 4/1995 | Stockwell et al. | D9/543 |
| 5,407,086 | A | 4/1995 | Ota et al. | 215/1 C |
| D358,333 | S | 5/1995 | Stockwell et al. | D9/531 |
| D358,547 | S | 5/1995 | Darr | D9/520 |
| D358,766 | S | 5/1995 | Vailliencourt et al. | D9/434 |
| 5,413,244 | A | 5/1995 | Ramsey | 220/671 |
| D359,449 | S | 6/1995 | Ota et al. | D9/434 |
| D360,582 | S | 7/1995 | McDonald et al. | D9/520 |
| 5,431,291 | A | 7/1995 | LaBombarbe, Jr. | 215/44 |
| 5,435,451 | A | 7/1995 | Dyer | 215/400 |
| D364,565 | S | 11/1995 | Vailliencourt et al. | D9/434 |
| 5,472,105 | A | 12/1995 | Krishnakumar et al. | 215/384 |
| D366,416 | S | 1/1996 | Semersky | D9/434 |
| D366,417 | S | 1/1996 | Semersky | D9/434 |
| D366,831 | S | 2/1996 | Semersky et al. | D9/434 |
| D369,110 | S | 4/1996 | Dyer | D9/520 |
| D376,978 | S | 12/1996 | Silvers et al. | D9/434 |
| 5,579,937 | A | 12/1996 | Valyi | 215/384 |
| 5,593,056 | A | 1/1997 | Mero et al. | 215/382 |
| D377,904 | S | 2/1997 | Hestehave et al. | D9/552 |
| 5,598,941 | A | 2/1997 | Semersky et al. | 215/384 |
| D379,763 | S | 6/1997 | Ewing, Jr. | D9/520 |
| 5,637,167 | A | 6/1997 | Krishnakumar et al. | 156/85 |
| D381,272 | S | 7/1997 | Coons | D9/540 |
| D382,485 | S | 8/1997 | Krishnakumar et al. | D9/543 |
| D382,799 | S | 8/1997 | Darr | D9/434 |
| D382,807 | S | 8/1997 | Silvers et al. | D9/520 |
| D383,067 | S | 9/1997 | Gower et al. | D9/520 |
| 5,669,520 | A | 9/1997 | Simpson | 215/11.1 |
| 5,671,864 | A | 9/1997 | Caruthers | 220/737 |
| D385,497 | S | 10/1997 | Krishnakumar et al. | |
| D386,088 | S | 11/1997 | Satoh | |
| D386,418 | S | 11/1997 | Edstrom et al. | D9/538 |
| 5,682,931 | A | 11/1997 | Mouchmouchian | 141/319 |
| 5,690,244 | A | 11/1997 | Darr | 215/382 |
| D387,284 | S | 12/1997 | Briggs et al. | |
| 5,704,503 | A | 1/1998 | Krishnakumar et al. | 215/381 |
| 5,704,506 | A | 1/1998 | Tobias et al. | 215/398 |
| 5,711,445 | A | 1/1998 | Robbins, III | 220/8 |
| D390,114 | S | 2/1998 | Young | D9/520 |
| D390,116 | S | 2/1998 | Larkin et al. | D9/528 |
| D391,160 | S | 2/1998 | Lauth | D9/502 |
| D391,168 | S | 2/1998 | Ogg | D9/538 |
| 5,713,681 | A | 2/1998 | Venne et al. | 401/202 |
| 5,732,838 | A | 3/1998 | Young | 215/384 |
| D393,210 | S | 4/1998 | Ewing, Jr. | D9/543 |
| D393,802 | S | 4/1998 | Collette et al. | D9/502 |
| 5,735,420 | A | 4/1998 | Nakamaki et al. | 215/373 |
| 5,735,421 | A | 4/1998 | Deemer et al. | 215/382 |
| 5,740,934 | A | 4/1998 | Brady | 215/381 |
| 5,758,790 | A | 6/1998 | Ewing, Jr. | 215/384 |
| 5,762,221 | A | 6/1998 | Tobias et al. | 215/381 |
| 5,785,197 | A | 7/1998 | Slat | 215/375 |
| 5,803,290 | A | 9/1998 | Bongiorno | 215/384 |
| D406,065 | S | 2/1999 | Cheng | |
| 5,908,127 | A | 6/1999 | Weick et al. | 215/382 X |
| 5,908,128 | A * | 6/1999 | Krishnakumar | 215/382 X |
| D415,681 | S | 10/1999 | Yourist | D9/434 |
| D419,872 | S | 2/2000 | Lane | |
| D420,587 | S | 2/2000 | Cheng et al. | D9/434 |
| D429,152 | S | 8/2000 | Lane | |
| D429,156 | S | 8/2000 | Williams et al. | |
| D429,166 | S | 8/2000 | Ogg | |
| D431,465 | S | 10/2000 | Cheng et al. | D9/434 |
| D432,019 | S | 10/2000 | Steward | |
| D435,219 | S | 12/2000 | Williams et al. | |
| 6,164,474 | A | 12/2000 | Cheng et al. | 215/384 |

* cited by examiner

BOTTLE WITH INTEGRATED GRIP PORTION

This Application is a divisional of U.S. provisional application Ser. No. 09/196,719 filed Nov. 20, 1998 now U.S. Pat. No. 6,164,474 incorporates by reference that application.

FIELD OF THE INVENTION

The present invention relates to bottles for storing and dispensing fluid, foodstuffs and other items, and more particularly to grip portions for such bottles.

BACKGROUND OF THE INVENTION

Bottles for storing and dispensing fluid and foodstuffs are well known. Most commonly, such bottles are blow-molded plastic containers that are hot-filled, i.e., filled when the product is in a hot state. Typically, such bottles are used to contain fluids, such as juices, or foodstuffs, such as sauces or jellies. Because such bottles are typically used repeatedly before their contents are consumed, they often have grip portions so that consumers can move the bottles to and from the refrigerator with a sure grip.

A typical prior art bottle having a grip portion is disclosed and described in U.S. Pat. Nos. D344,457; 5,392,937; and 5,598,941. The bottle shown in these patents has two grip portions, one on each side of the bottle. Each grip portion is a recessed portion to provide an area of reduced bottle width that is easier for a user to grip. The grip portions in theses patents comprise ribs, oriented vertically, which are simply projections provided to further facilitate a better grip on the container. Other prior art bottles utilize horizontal ribs.

Prior art grip portions provide improved grips over conventional bottle designs. These grip portions, however, are basic improvements, and often do not provide a comfortable grip that is easy to use. It is, therefore, desirable to provide a grip portion for a bottle that is economically designed and easier to use than conventional grip portions.

SUMMARY OF THE INVENTION

A bottle for storing and dispensing contents comprises at least one grip portion for improving a user's grip on the bottle. The grip portion is situated on the side of the bottle and extends at least partially along the height of the bottle and comprises a recessed grip panel formed in the side of the bottle adapted to receive the user's fingers and the grip panel is tapered at an angle with respect to the vertical direction.

In a preferred embodiment, the back of the bottle is thinner than the front so that a user can grip the bottle from the back. Preferably, the grip panel is adapted to receive user's fingers from the back of the bottle and further comprises at least one rib situated on the grip panel and inclined at an angle with respect to the horizontal direction. Preferably, there are a plurality of ribs inclined at a first angle and a plurality of cross-hatch ribs inclined at a second angle, the second angle differing from the first at approximately ninety degrees and the ribs forming a lattice arrangement.

In another preferred embodiment of the present invention, the bottle further comprises at least one ridge, preferably a plurality, situated on the side wall of the bottle for providing strength and rigidity to the bottle. The ridge is a depression not more than 0.5 inch wide across a part of the height of the bottle, has an underside, and extends at least partially along the side wall and comprises a lower portion that extends from the side wall toward the center axis of the bottle so that the contents beneath or on the underside of a the ridge can be reached with a utensil. Preferably, a cross section of the lower portion of the ridge is a straight line extending from the side wall of the bottle at least partially toward the center axis of the bottle and the ridge has an upper portion having a cross section of an arc extending from the side wall toward the center axis of the bottle so that the cross section of the lower portion of the ridge meets the cross section of the upper portion at a tangent.

Another aspect of the present invention includes a bottle having a plurality of ridges situated on the bottle's side wall for providing strength and rigidity to the bottle, wherein the ridges or depressions have varying widths across a part of the height of the bottle. In this embodiment, a first ridge having a width greater than the width of a second ridge provides greater strength and rigidity to the bottle at the first ridge's location than the second ridge provides at the second ridge's location.

DETAILED DESCRIPTION OF THE PREFERRED EMBODIMENTS

Figure 1:
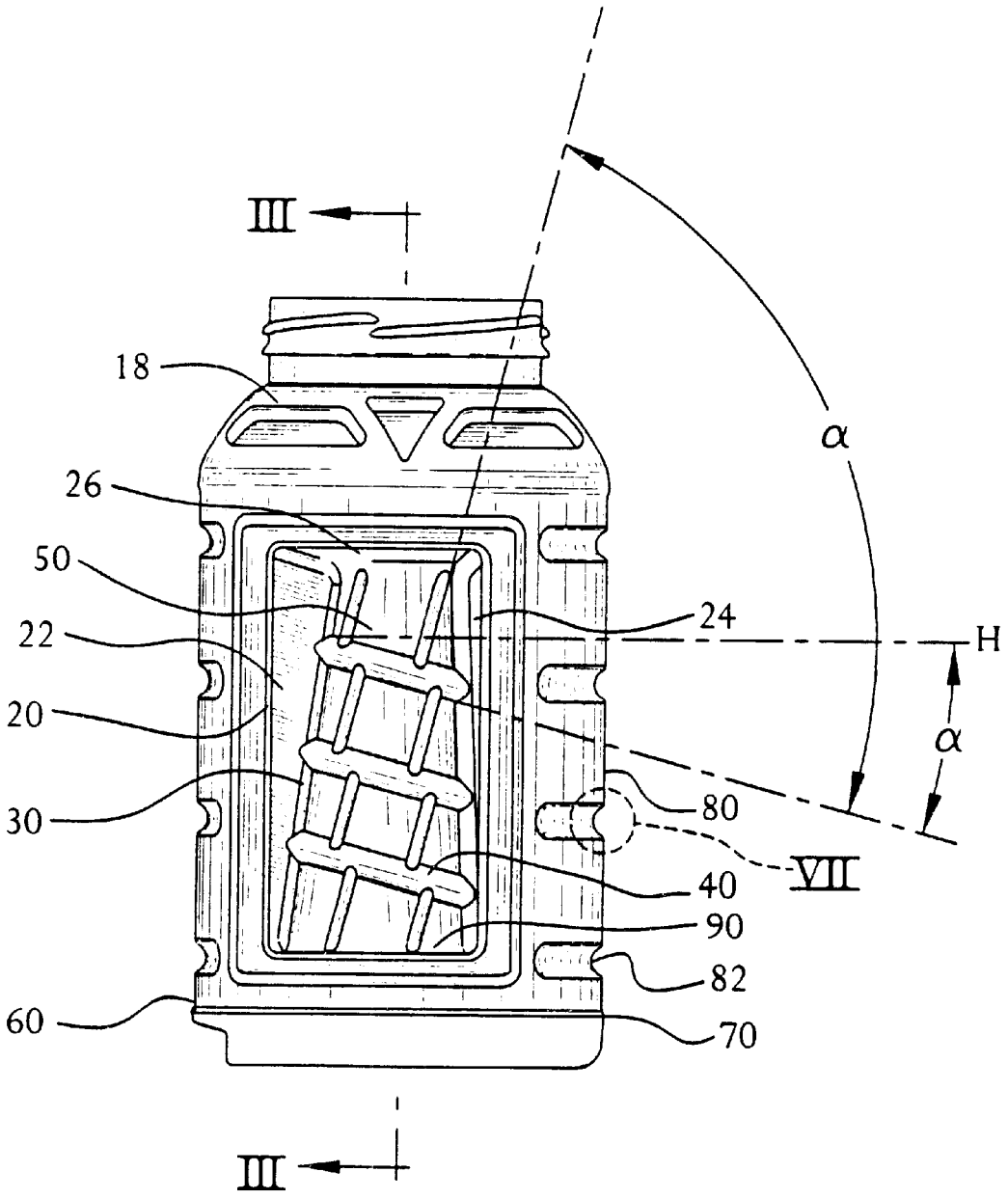
FIG. 1 is a side view of a bottle having a grip portion of the present invention.

The purpose of the present invention is to provide a grip portion for a bottle that is economically designed and easier to use than conventional grip portions. FIG. 1 shows a side view of a bottle having a grip portion 20 according to the present invention. Preferably, there is one grip portion 20 on each side of a bottle. Each grip portion 20 comprises a grip panel 30, first and second triangular panels 22 and 24, and a trapezoidal panel 26.

Figure 3:
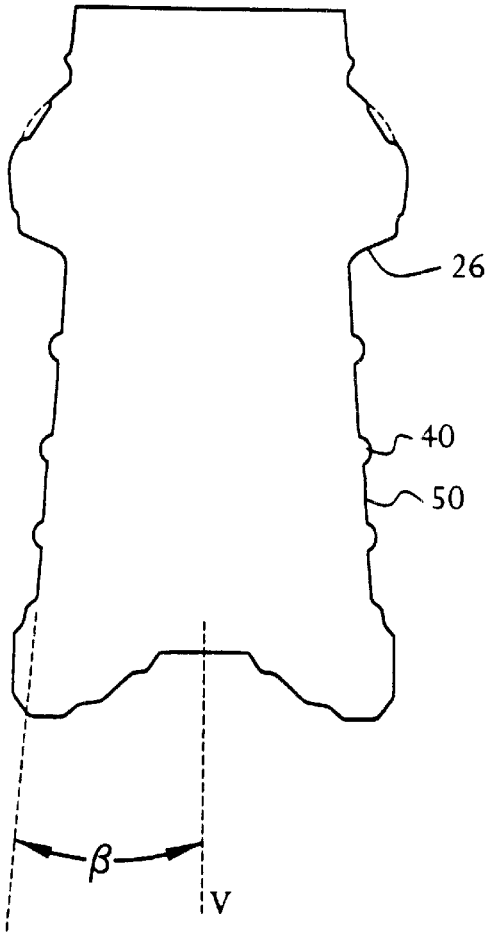
FIG. 3 is a longitudinal cross-sectional view of the bottle of FIG. 1 along line III—III.

Each preferred grip panel 30 comprises three inclined ribs 40, four finger slots 50, and eight cross-hatch ribs 42. The three inclined ribs 40 divide the panel 30 into four finger slots 50 for receiving a user's fingers. The two cross-hatch ribs 42 per each finger slot 50 are provided to prevent a user's fingers from sliding too far along the finger slot 50. Together, the inclined ribs 40 and the cross-hatch ribs 42 provide a lattice arrangement of ribs or ridges for ensuring a sure grip for a user. Preferably, as shown in FIG. 1, the angle $\gamma$ between the inclined ribs 40 and the cross-hatch ribs 42 is between approximately 60 degrees, more preferably approximately 60 degrees, and most preferably approximately 90 degrees. FIG. 3 shows a longitudinal cross-sectional view of the bottle of FIG. 1 along line III—III.

Figure 4:
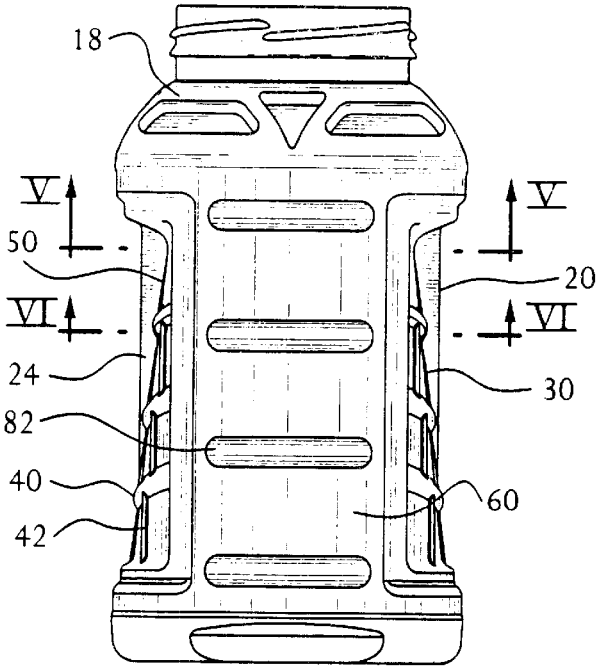
FIG. 4 is a rear view of the bottle of FIG. 1.
Figure 2:
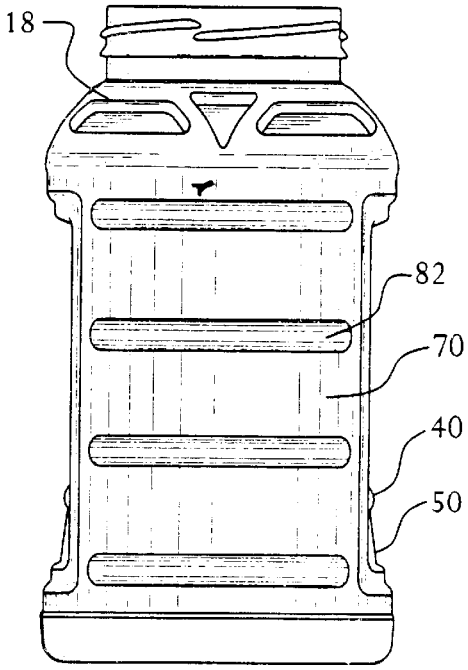
FIG. 2 is a front view of the bottle of FIG. 1.
Figure 5:
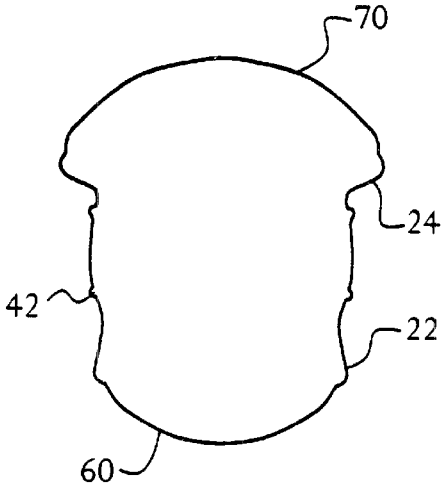
FIG. 5 is a cross-sectional view of the bottle of FIG. 4 along line V—V.
Figure 6:
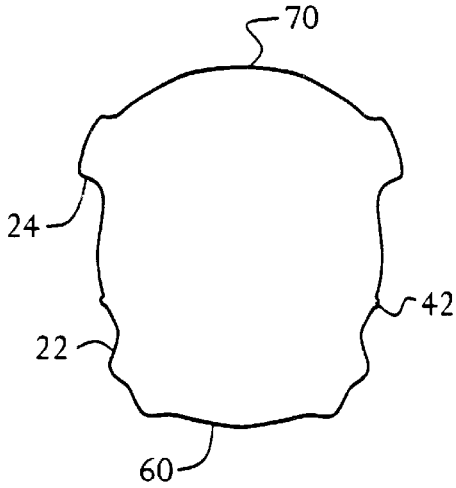
FIG. 6 is a cross-sectional view of the bottle of FIG. 4 along line VI—VI.

FIG. 4 shows a rear view of the bottle of FIG. 1 and FIG. 2 shows a front view of the bottle of FIG. 1 (the back 60 and front 70 of the bottle are shown in FIG. 1). As shown in FIGS. 2 and 4, the inclined ribs 40 are inclined downward as they extend from the rear 60 of the bottle to the front 70. In addition, each grip panel 30 is tapered so that it is angled inward (toward the center of the bottle) as it extends from the bottom of the bottle to the top. FIG. 5 shows a cross-sectional view of the bottle of FIG. 4 along line V—V. FIG. 6 shows a cross-sectional view of the bottle of FIG. 4 along line VI—VI.

As with prior art grip portions, a user places a hand over the back 60 of the bottle to grip the container with their thumb on one side and their four other fingers on the other side of the bottle. As shown in FIGS. 5 and 6, at the height of the grip portion 20 and grip panel 30, the back 60 of the bottle is thinner than the front 70 so that the bottle is easier to grasp from the back 60. When a user's hand is placed on the bottle, the thumb will naturally fit in the uppermost or second uppermost finger slot 50. By means of the finger slots 50, the grip panels 30 of the present invention provide places on a bottle for individually receiving the fingers of one's hand.

In addition, because the ribs 40 on the grip panels 30 are inclined, the finger slots 50 also are inclined, thereby providing easier gripping. It is believed that one naturally reaches for a bottle in a slightly downward direction because it is frequently below the height of one's elbow. Thus, as one reaches for a bottle having the grip portion 20 of the present invention, the user's fingers will naturally fall into place.

In the present invention, the amount by which the grip portions 20 are recessed varies from bottom to top. As shown in FIG. 4, the recessed area at the bottom of the grip portion 20 is not as great as the recessed area at the top of the grip portion 20, which corresponds to the angle at which the grip panels 30 are tapered. As shown in FIG. 1, the first and second triangular panels 22 and 24 and the trapezoidal panel 26 connect the recessed grip panel 30 to the outer surface 80 of the bottle. The bottom side 90 of the grip panel 30 is attached directly to the outer surface 80 of the bottle.

The shape of the grip portions 20, including the shoulder area 18, also prevent the bottle from collapsing due to vacuum absorption. Bottles are often hot-filled, i.e., when the containers are filled with a fluid, the product is above room temperature. When the fluid is cooling down to room temperature, however, the bottle is affected by vacuum forces tending to cause the bottle to buckle or collapse inward. The bottle of the present invention prevents this collapse.

As shown in FIGS. 1, 2, and 4, the preferred bottle of the present invention also has horizontal ridges 82, which are arc-shaped depressions that span the circumference or outer surface of the bottle 80 in between the grip portions 30. These horizontal ridges 82, as well as the lattice arrangement of the inclined ribs 40 and the cross-hatch ribs 42, provide axial and radial strength and rigidity and help to prevent collapse due to vacuum absorption.

It is generally known that the thumb, index finger and middle finger perform most of the gripping, i.e., exert most of the gripping force, when one grips an object. Therefore, by means of the tapered grip panels 30, the grip portion 20 of the present invention provides for the varying gripping force that a user's hand applies. The grip portion 20 is thinner where the user's hand exerts the most force and wider where the user's hand exerts the least force. In this way, a user's entire hand can be used to effectively grip the bottle.

The tapering of the grip panels 30 and the inclination of the inclined ribs 40 also contribute to the overall improved functionality of the bottle. When the contents are foodstuffs, such as peanut butter or apple sauce, the taper of the grip panels 30 allows for a user with a utensil, such as a butter knife or spoon, to scoop out the contents of the bottle. When inserted through the opening, a utensil such as a butter knife will more naturally contact the side of the bottle at the grip panels 30, thereby allowing a user to consume more of the contents and do so with greater ease. Similarly, the inclined ribs 40 allow a user to gain access to the area that the ribs 40 occupy.

Figure 7:
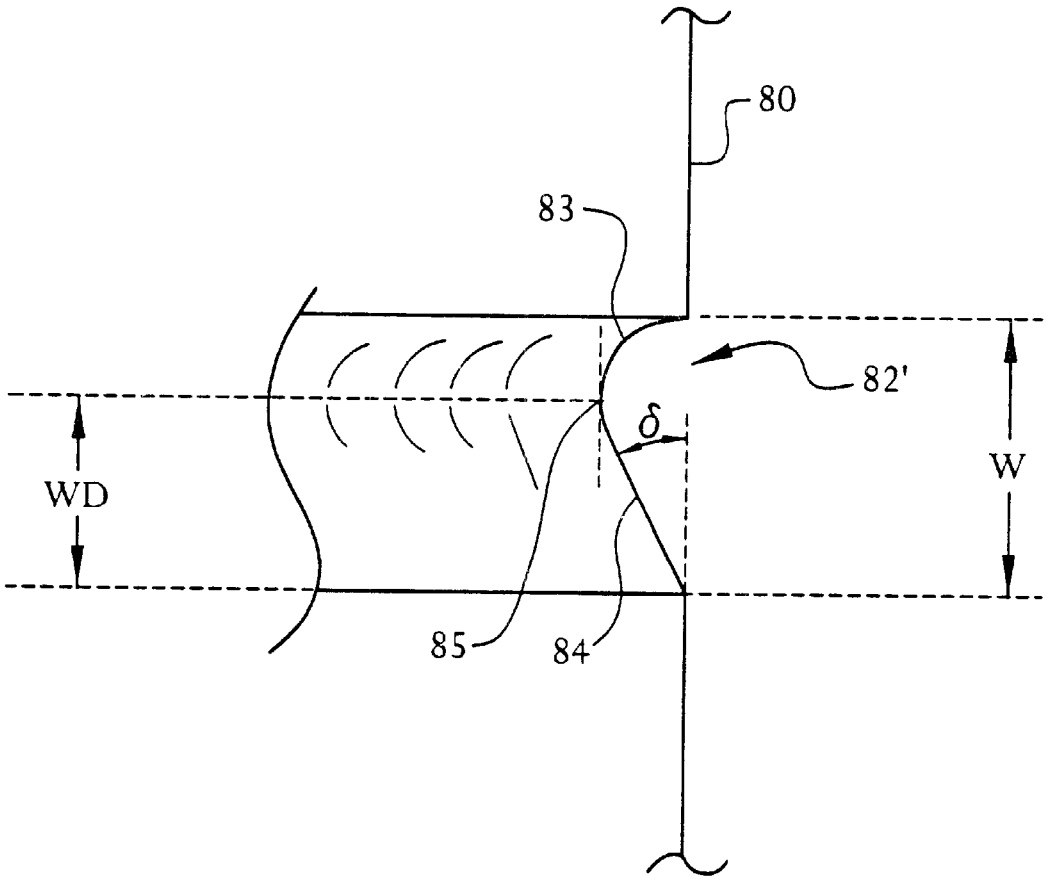
FIG. 7 is an enlarged alternative view of section VII of the bottle of FIG. 1.

Another aspect of the bottle of the present invention is depicted in FIG. 7. FIG. 7 shows an enlarged alternative view of section VII of the bottle of FIG. 1 around one of the horizontal ridges 82. Prior art ridges, such as the horizontal ridges 82, have semi-circular cross sections. The alternative improved ridge 82' of FIG. 7 enables a user with a utensil, such as a butter knife or spoon, to scoop out more of the contents of the bottle while the ridge 82' still provides axial and radial strength and rigidity to help prevent collapse due to vacuum absorption. With semicircular ridges 82, foodstuffs can hide beneath the underside of the ridge 82, where a utensil cannot gain access because of the circular cross-sectional shape of the ridge 82.

The cross section of a preferred improved ridge 82' generally comprises an arc 83 forming the upper part of the ridge 82', extending from the side 80 of the bottle to the center of the bottle, and a tangent line 84 forming the lower part of the ridge 82', extending from and tangential to the arc 83 to the side 80 of the bottle. Preferably, the width W of a ridge 82' across a part of the height of the bottle is not more than approximately 0.5 inch. More preferably, the width W of a ridge 82' across a part of the height of the bottle is approximately 0.3 inch for a 32 oz. bottle and is between approximately 0.23 inch and approximately 0.38 inch for a 64 oz. bottle.

Preferably, the tangent line 84 has an angle 6 from the vertical side of the bottle 80 between approximately 5 degrees and approximately 45 degrees, more preferably between approximately 20 and approximately 45 degrees, and most preferably is approximately 40 degrees. In general, the benefit of the improved ridge 82' will be realized if foodstuffs beneath or on the underside of a ridge 82' can be reached with a utensil.

As shown in FIG. 7, width WD is the distance across a part of the height of the bottle measured from the point where the lower portion 84 of the ridge 82' meets the side wall 80 of the bottle to the height up the side wall 80 to where the deepest point 85 of the depression of the ridge 82' is located. Preferably, the width WD for each ridge 82' is greater than or equal to half the value of the width W of the ridge 82' across a part of the height of the bottle, i.e., $WD \geqq \frac{1}{2}W$.

The amount of incline a, as shown in FIG. 1, of the inclined ribs 40 on the grip panels 30 may be varied to obtain optimum results. Preferably, the amount of incline is between approximately 5 degrees and approximately 25 degrees from horizontal (line H in FIG. 1), more preferably between approximately 10 degrees and approximately 20 degrees, and most preferably 15 degrees from horizontal. Alternatively, the ribs 40 may be constructed without any incline.

In addition, although it is preferred for the inclined ribs 40 to be inclined downward as they extend from the rear 60 of the bottle to the front 70, the ribs 40 may be inclined upward within the principles of the invention. Users such as young children that reach upward for bottles would find such grip portions 30 to be advantageous. The foregoing angles specified for downward inclines also would be appropriate for upward inclines.

The angle β, as shown in FIG. 3, at which the grip panels 30 are tapered also may be varied to obtain optimum results. Preferably, such angle is between approximately 2 degrees and approximately 25 degrees from vertical (line V in FIG. 3), more preferably between approximately 3 degrees and approximately 20 degrees, even more preferably between approximately 4 degrees and approximately 15 degrees, yet more preferably between approximately 5 degrees and approximately 10 degrees, and most preferably approximately 6 degrees from vertical.

Figure 8:
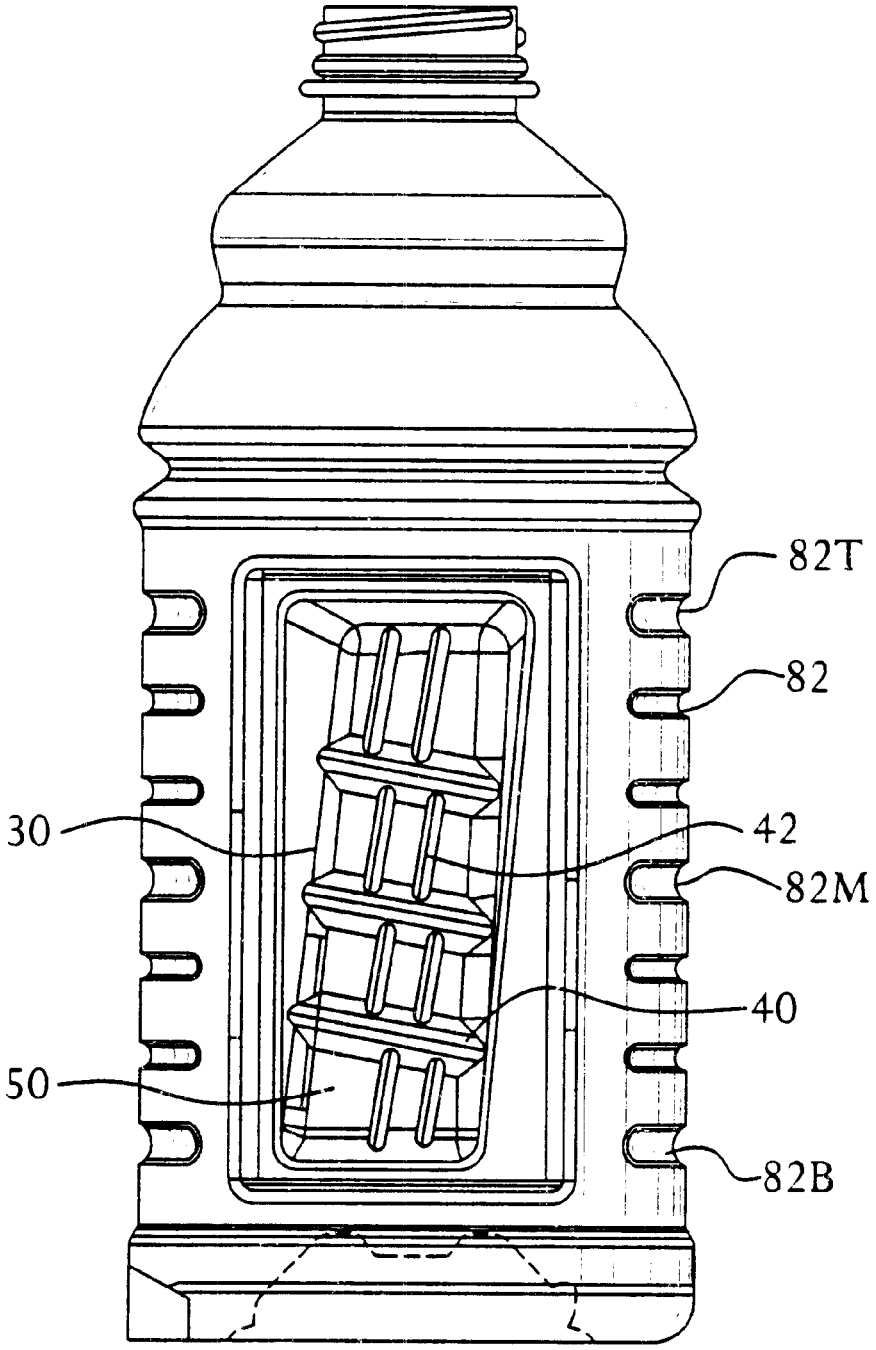
FIG. 8 is a side view of an alternative embodiment of a bottle having a grip portion of the present invention.
Figure 9:
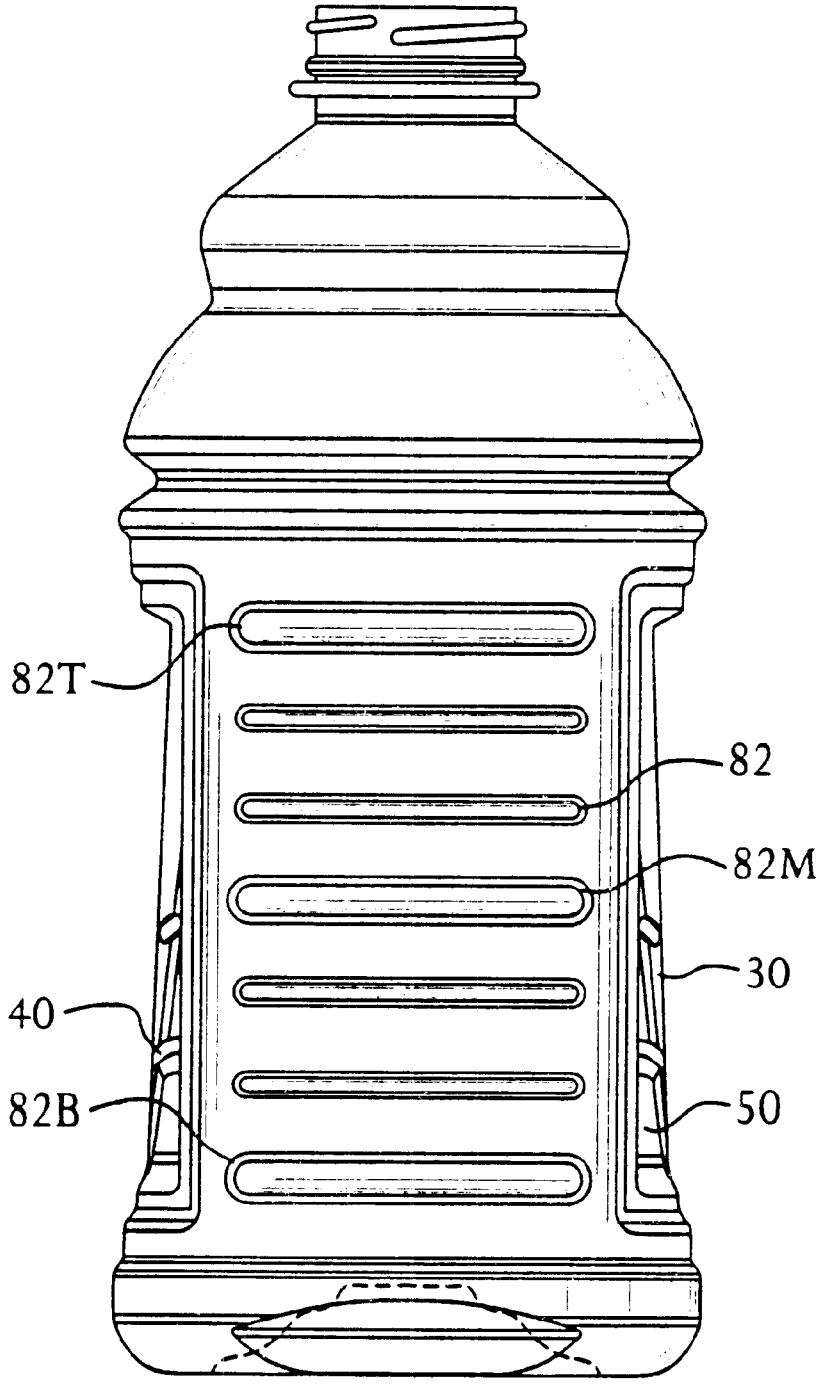
FIG. 9 is a rear view of the bottle of FIG. 7.

An alternative embodiment of a bottle having a grip portion 20 according to the present invention is shown in FIG. 8. FIG. 9 is a rear view of the bottle of FIG. 8. The bottle of FIGS. 8 and 9 is larger than the bottle shown in FIG. 1, designed to accommodate a larger capacity. In preferred embodiments, the bottle of FIG. 1 is designed to hold approximately 32 ounces and the bottle of FIG. 8 is designed to hold approximately 64 ounces. A relatively large bottle, such as that in FIG. 8, is well suited for fluids such as juices, whereas a relatively small bottle, such as that of FIG. 1, is well suited for foodstuffs such as sauces or jellies.

For larger bottles, such as that of FIG. 8, more radial and axial strength is necessary to withstand greater vacuum absorption forces than those imposed on smaller bottles. Accordingly, with larger bottles, certain structural features are increased in size to accommodate for the increased forces. For example, with the bottle of FIG. 8, the horizontal ridges 82 may be larger than those of the bottle of FIG. 1 and/or also may vary in size on a particular bottle. As shown in FIGS. 8 and 9, key areas are reinforced, i.e., have larger horizontal ridges. These key areas where collapse is most undesirable, at heights near the top, middle and bottom of the grip panel 30, have horizontal ridges 82T, 82M and 82B, respectively, so that these areas have a lesser chance of collapsing due to vacuum absorption.

The bottle of the present can be made from conventional blow molding techniques used to manufacture plastic bottles. In addition, the bottle of the present invention may be manufactured using a spin trim blow molding technique in which one starts with a preform larger than is needed. Thus, a bottle is blow molded having an extra portion, typically a longitudinal extension, which is trimmed off to yield the finished bottle.

The present invention is further disclosed in commonly assigned U.S. Pat. Des. No. 420,587, entitled "Bottle with Integrated Grip Portion" and U.S. Pat. Des. No. 431,465, Nov. 20, 1998, entitled "Bottle with Integrated Grip Portion"; and Ser. No. 29/096,834, filed on Nov. 20, 1998, entitled "Bottle with Integrated Grip Portion"each of which is hereby incorporated by reference herein in its entirety.

It is to be understood that even though numerous characteristics and advantages of the present invention have been set forth in the foregoing description, together with details of the structure and function of the invention, the disclosure is illustrative only. Accordingly, changes may be made in detail, especially in matters of shape, size and arrangement of parts within the principles of the invention to the full extent indicated by the broad general meaning of the terms in which the appended claims are expressed.

What is claimed is:

1. A hot-fill able bottle for strong and dispensing contents, the bottle having a height and comprising:

an enclosed base;

a body extending upwardly from the base, the body including a font and a back; and a pair of opposing sides coupled to the front and the back; each one of the sides including a grip portion, each one of the grip portions extending at least partially along the height of the bottle and including a recessed grip panel, and wherein the grip portion acts as a vacuum panel capable of withstanding internal vacuum;

the grip panels being mutually spaced apart at a bottom portion thereof to define a bottom spacing dimension and at a top portion thereof to define a top spacing dimension, the bottom spacing dimension being greater than the top spacing dimension such that the grip panels are inwardly angled in longitudinal cross section, the grip panels being mutually spaced apart at a back portion thereof to define a back spacing dimension and at a front portion thereof to define a front spacing dimension, the front spacing dimension being greater than The back spacing dimension such that the bottle is thinner at the back than at the front, whereby the bottle is easier to grasp at the back than at the front.

2. The bottle of claim 1, wherein the angle is between approximately 2 degrees and approximately 25 degrees.

3. A hot-fillable bottle for storing and dispensing contents, the bottle having a height and comprising:

a pair of opposing sides;

a front and a back coupled to the opposing sides; and at least one grip portion for improving a user's grip on the bottle, the at least one grip portion situated on one of the pair of opposing sides of the bottle and extending at least partially along the height of the bottle, the grip portion acting as a vacuum panel capable of withstanding internal vacuum, the at least one grip portion comprising:

a grip panel being recessed and tapered at an angle with respect to a vertical line;

a first panel extending between the grip panel and the back; and a second panel extending between the grip panel and the front;

wherein the first panel is sized differently than the second panel and the first and second panels are triangular-shaped.

* * * * *